United States Patent [19]

Mason et al.

[11] 4,005,661

[45] Feb. 1, 1977

[54] FOLDING UMBRELLA TABLE

[76] Inventors: Dewey Mason, 6428 S. 42nd W. Ave., Tulsa, Okla. 74107; Riley C. Mason, Rte. 2, Box 25, Hulbert, Okla. 74441

[22] Filed: Jan. 14, 1975

[21] Appl. No.: 540,826

[52] U.S. Cl. ..... 108/128

[51] Int. Cl.[2] ..... A47F 3/00

[58] Field of Search ..... 108/115, 111, 112, 113, 108/114, 128; 135/2, 3 C, 16, 25 R, 33; 248/155.3

[56] References Cited

UNITED STATES PATENTS

| | | | |
|---|---|---|---|
| 179,012 | 1/1876 | Graham | 108/128 X |
| 512,325 | 1/1894 | Reeves | 108/128 |
| 786,732 | 4/1905 | Crandall | 108/112 |
| 1,226,554 | 5/1917 | Mante | 108/128 |
| 1,277,988 | 9/1918 | Miller | 108/112 |
| 2,445,489 | 7/1948 | Mangold | 108/128 X |
| 2,560,079 | 7/1951 | Blum | 248/155.3 |
| D204,391 | 4/1966 | Obayashi | 108/115 X |

FOREIGN PATENTS OR APPLICATIONS

| | | | |
|---|---|---|---|
| 373,509 | 4/1923 | Germany | 108/128 |

*Primary Examiner*—James T. McCall
*Attorney, Agent, or Firm*—Head, Johnson & Chafin

[57] ABSTRACT

A folding umbrella table comprising a central column for supporting the table, the column comprising two nesting cylindrical portions, the bottom portion having means for applying supporting legs to hold the column upright. At the top of the column is a circular plate with a plurality of radial slots near the edges. Means are provided for inserting and locking into the slots, a plurality of radial arms each of which is formed of angular material, one web of the angle in the form of a triangle, and the other web of the angle a narrow web of uniform width. Of the entire plurality of segmental arms, there are a first plurality of special support arms, which have a wider vertical web than the others. These act as support for the other segmental arms. There are six of these supporting arms, each of which is adapted to hinge from a horizontal to a vertical position. Each is held in a horizontal position by a folding bracket which is attached by hinge means to the central column of the table. There are two hinged channels between each pair of the six support arms, near the outer ends of the arms. The purpose of these channels is to support the intermediate segmental arms having the short vertical web, which webs rest on the channels, which are hinged to the support arms.

6 Claims, 12 Drawing Figures

FOLDING UMBRELLA TABLE

BACKGROUND OF THE INVENTION

This invention lies in the field of portable furniture. More particularly, it lies in the field of collapsible or folding furniture.

In the prior art there are many types of folding and collapsible furniture, such as tables, in which legs may fold into the plane of the table. While the overall volume of the table is reduced by the folding, the table itself may be of some considerable size and therefore difficult to stow away or to carry when traveling, etc. In this invention, the table and chairs collapse into a single small volume, roughly in the form of a cylinder less than 2 feet long and about 8 inches in diameter, which is convenient for carrying, packing or storing.

SUMMARY OF THE INVENTION

It is a primary object of this invention of provide a collapsible or folding table, which can be collapsed from an operating size to a small volume for transportation of storage.

This and other objects are realized and the limitations of the prior art are overcome in this invention by making the table of circular shape, with a central support column. The support column is made of two telescoping tubes, the one of lesser diameter is the bottom one, and this tube carries a cylindrical plug which slides within the tube and which itself carries the legs. The legs can be hinged to spread out in a radial direction or they can be moved into a longitudinal or axial direction, so that the legs can slide into the lower tube, and the lower tube can slide into the upper tube to provide a collapsed column of the size of approximately 4 inches in diameter by 18 inches long.

The table top comprises a central circular plate which is attached to the top end of the upper cylinder. The outer edge of the top plate carries a plurality of radial slots into which are fastened, in a hinged manner, a plurality of segmental arms, which, when in a horizontal position, provide a complete circular surface, and when in a vertical position provide an outer contour which is of a cylindrical shape, about 8 inches in diameter by 18 inches long. Collapsible means are provided attached to the column, for supporting the segmental arms in a horizontal plane, so that the table surface will be smooth and will be able to support considerable weight.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
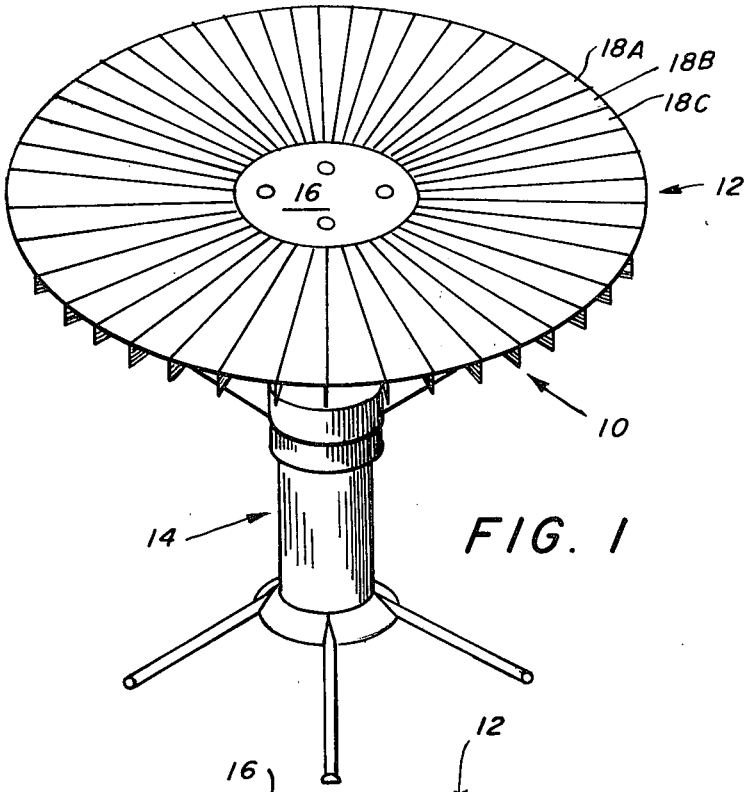
FIG. 1 illustrates an overall view of the umbrella table in an expanded condition.

Referring now to the drawings and in particular to FIG. 1 there is shown a general view of the folding table indicated generally by the numeral 10. The numeral 12 indicates generally the table top and the numeral 14 indicates generally the supporting column for the table.

The table top comprises a central plate 16 with a central boss 17 which fits inside of a tubular column 32 which is part of the support column 14 for the table. Hinged to the plate 16 along its periphery are a plurality of tapered segments or segmental arms 18A, 18B, 18C, etc. which will be described more in detail in connected with FIGS. 9, 10.

Figure 3:
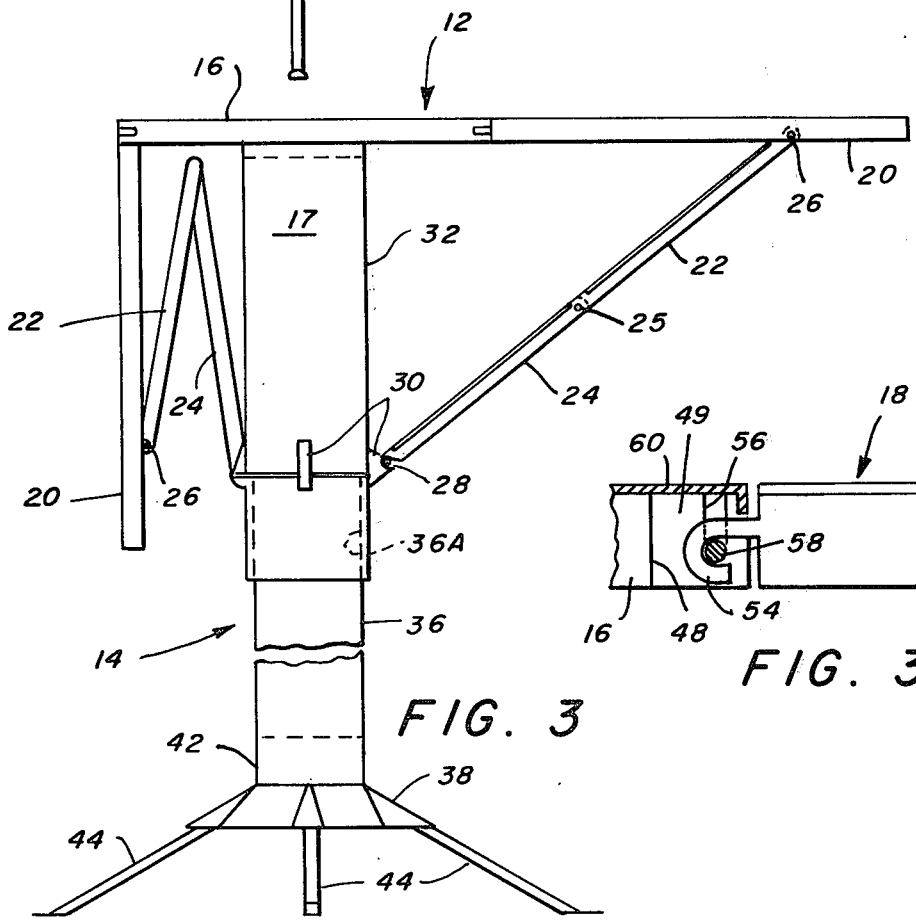
FIG. 3 shows a detail of the support means for the table segmental arms and details of the column.

Referring to FIG. 3 there is shown a side view of the table with a central plate 16 supported by means of its boss 17 in the tube 32. The tube 32 slides over a smaller tube 36 so that the two tubes 32 and 36 can be telescoped to a length comparable to that of the tube 32. When extended, the two tubes 32 and 34 are locked by means of a simple latch such as is well known in the art.

Figure 6A:
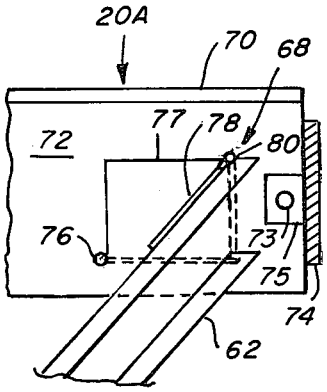
FIG. 6A illustrates the hinged bracket means for the support of the segmental arms.
Figure 6:
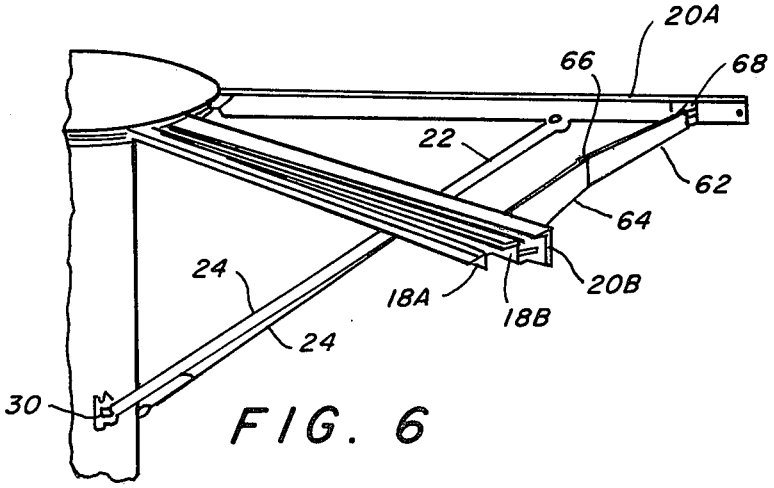
FIG. 6 illustrates details of a means of supporting these segmental arms of the table.

Referring briefly to FIG. 6 there are shown two different types of segmental arms, a plurality labeled 18A, 18B, etc. and a lesser number labeled 20A, 20B, etc. There are six of the type labeled 20 where are equally spaced around the table. As will be described in connection with FIGS. 9, 10, each of these segmental arms is made of angular material of aluminum or plastic, etc. and has a tapering horizontal web or surface and a vertical web surface. The six arms 20 have a wider vertical web and they are supported in a horizontal portion, as shown in FIGS. 3 and 6, by means of hinged brackets 22, 24, which are hinged to each other at point 25, and fold up as is shown in the left side of FIG. 3. The brackets are hinged to the arms 20 by means of pins 26 and are supported by the column 32 by means of brackets 30, which can be of any convenient form so as to provide a hinge at the points 28.

As shown in FIG. 6, near the outer end of the arms 20 are a pair of hinged channels 62 and 64, they are hinged together by means of a pin 66 and are hinged 68 to the vertical web of the arms 20. A detail of the hinge mechanism 68 will be shown in greater detail in connection with FIG. 6A.

The vertical web of the angles 18 are of shorter dimension that the vertical web of the angles or arms 20, such that the vertical webs of the arms 18 can rest on the hinged channels 62, 64 and their top webs will then be co-planar with those of the arms 20.

It will be clear therefore, that in setting up the table, if the vertical columns 32, 36 are set up, the plurality of segmental arms 20 which are hinged to the plate 16 can be raised. The six arms 20 are more sturdy than the arms 18 and are supported by the hinged brackets 22, 24 in a horizontal position. The spaces between the arms 20 are connected by the hinged channel 62, 64, on which rest the intermediate arms 18A, 18B, etc. Therefore, once the arms 20 are set and locked into a horizontal position, all of the segmental arms of the table will then fit in conjunction with each other to provide at continuous horizontal surface as shown in FIG. 1.

Figure 3A:
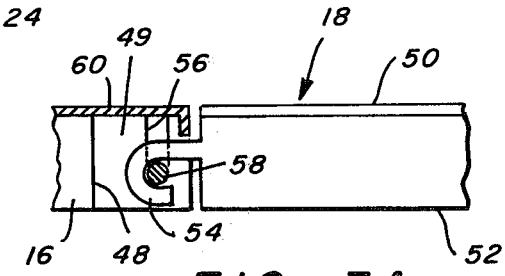
FIG. 3A shows in partial section of portion of the edge of the central plate of the top and one of the arms.
Figure 4:
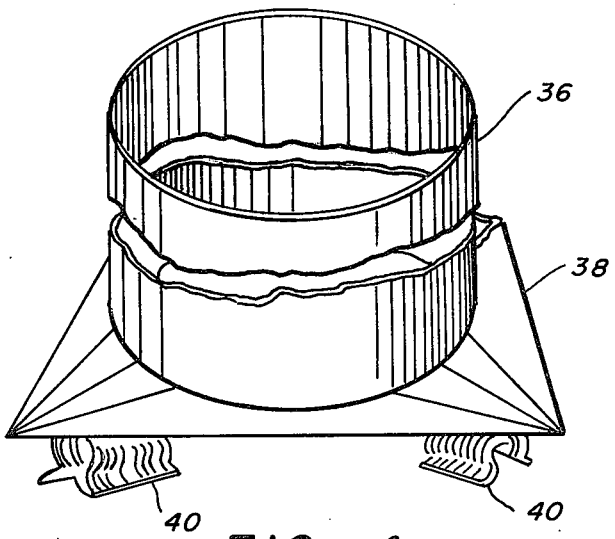
FIG. 4 illustrates a detail of the bottom cylindrical tube of the column.

Referring now to FIG. 3A, there is shown in partial section a portion of the edge of the central plate 16 of the top, and one of the arms 18. This arm has a horizontal tapered web 50, and a vertical web 52. An extension of the vertical web 52 is shaped in the form of a hook 54. The table plate 16 has a plurality of radial notches, equal in number to the segmental arms of the table. The notch is indicated by the line 48 which is the inner edge of the notch. The surface 49 is one side surface of the notch. The notch is of such width that the hook 54 will slide freely in the notch 48. There are a plurality of vertical notches 56, one in each of the tongues between the notches 48. A ring of steel wire 58 can be dropped into the notches 56 around the table. The cap indicated by numeral 60 is a cover plate which is placed over the plate 16 and fits tightly, so as to lock the hooks 54 and ring 58 into the notches in the edge of the plate 16. In the assembly of the arms 18 the wire ring is dropped into the slot 56 and each of the hooks 54 are put into the slots 48 and hooked around the wire 58 and then the top cover plate 60 is put in position holding all of the arms locked to the central plate 16 of the table.

It will be clear that the arm 18 shown in FIG. 3A can be lowered to a vertical position by simply swiveling the hook 54 around the wire 58. This can be done once the arms 20 are lowered by folding the hinged bracket 22, 24 to the position shown in the left side of FIG. 3. As the channels 62 and 64 are lowered with the arms 20, the arms 18 fall into a vertical position.

Figure 2:
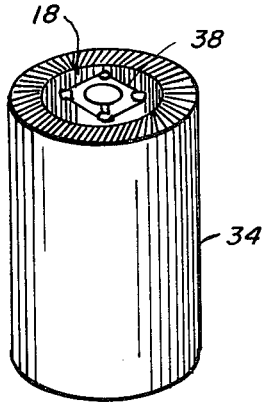
FIG. 2 is a view of the table in collapsed form.

In FIG. 2 is shown a view of the table in collapsed of folded position. There is a cannister, or cylindrical can, 34 which is large enough in diameter so as to slip over the central plate 16 and the hanging arms 18 and 20. While the table central column is still standing, the arms 18 and 20 can be lowered and the can 34 inserted over the top of the arms. Next the table and can are turned over, and the cylinder 36 is unlatched and inserted its full length inside of the cylinder 32.

Figure 5:
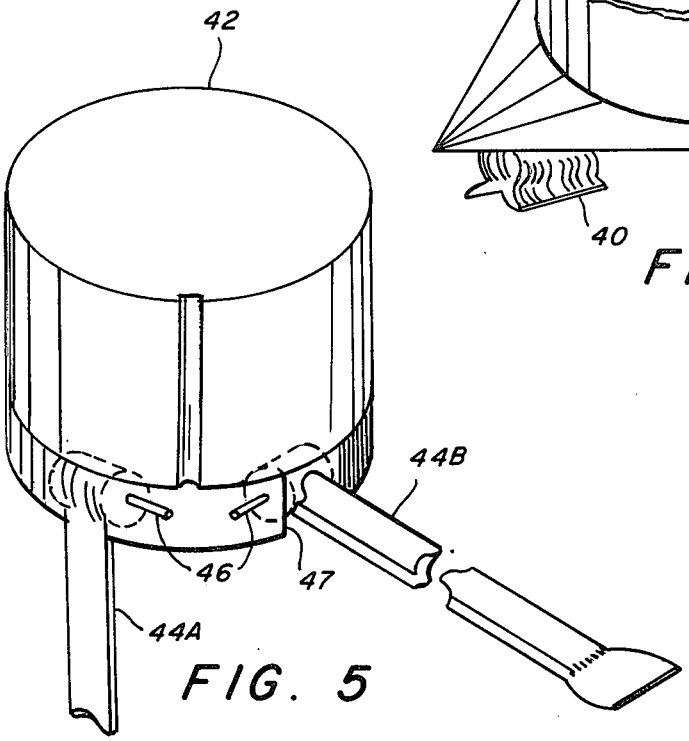
FIG. 5 illustrates a means of attachment of legs and the support of the legs by the lower tubular portion of the central column.

The legs 44 as shown in FIG. 5 are hinged to a cylindrical block 42 by means of pins inserted into drill holes, while the arms are set into slots 47 in the block 42. The block 42 is shown in the dashed outline in FIG. 3 and is positioned inside of the tube 36 by leg 44A, and inserting the block with legs down into the tube 36 and through the bottom openings. There is a plate 38 over the bottom of the tube 36 which serves to keep the plug 42 from falling through the tube 36. Plate 38 may be round or rectangular, and flat or conical. When the legs are spread open as shown in FIG. 3, The block 42, leg 44, plate 38, are held together by means of spring clips 40 attached to the plate 38.

When the table is folded as indicated above, the arms 18 and 20 are lowered, the canister 34 is lowered over the table top 16 and the arms, and the table then in turned upside down. The legs are unhooked from the spring clips 40 to an axial position and the legs and block 42 are pushed into the tube 36, and the tube 36 is slid into the tube 32, so that the central column now is hidden within the tube 32, and the plate 38 is the only part extending from it. The view of FIG. 2 shows the plate 38 and the ends of the plurality of arms 18, 20 in the canister 34. As will be described in connection with FIGS. 7, 8 the canister 34 can be a group of canisters, of such tapered design and size so that they can be inserted one inside of the other, with the inside canister of sufficient dimension that the table can be packed inside of it. The canisters are closed on the bottom end, and can be turned over and used as stools for persons sitting at the table. Thus the collapsed table shown in FIG. 2 is a table and four stools in position for packing or storage.

As shown in FIG. 6 when the table is opened, the arms 18 and 20 are in contiguous position with their horizontal surfaces in a single plane, namely the plane of the table, and their vertical webs all in vertical radial planes. However, when the table is collapsed, and in the position shown in FIG. 2, it will be clear that the vertical surfaces of the arms 18, 20 now become radial surfaces with respect to the assembly. This means that the hinge 68 as shown in FIG. 6, of the channels 62, 64 to the arms 20A and 20B cannot be a simple hinge, because there has to be a relative turning of the two arms 20A and 20B with respect to the channels 62 and 64. Such a double hinge is illustrated in FIG. 6A where the arm 20A is indicated having a horizontal web or surface 70 and a vertical web or surface 72. There are two hinges, a first hinge having plate 77, with another plate directly behind it, attached to the vertical surface 72, and the two plates tied with a hinge pin 76, which is in a longitudinal direction on the web 72 of the arm 20A. Plate 77 with the plate 78, which is attached to channel 62, make up the second hinge, having a hinge pin 80, which is perpendicular to the hinge pin 76. When the table is set up, and the surfaces 72 are all vertical, then the first hinge is completely closed, and the only effective hinge is the second one having plates 77 and 78. On the other hand, when the table arms 18, 20 are collapsed, then the first hinge with hinge pin 76 comes into play.

In FIG. 6A is shown another detail, which is a loop of thin plastic strip (such as Nylon, for example) labelled 74, and having a plurality of spaced perpendicular tabs 75 on its inner surface. There are as many tabs as there are arms 18, 20, and each arm has a tab fastened to it, as by bolt or rivet 73. The purpose of the loop 74 is to space the arms at equal angles when the table is opened. In the closed position the loop and tabs are flexible enough to permit the arms to move close together.

Figure 10:
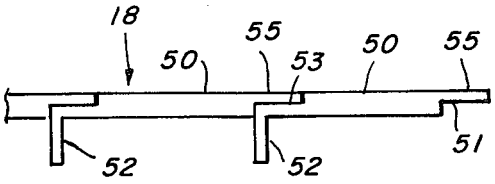
FIGS. 9 and 10 show details of the segmental arms.
Figure 9:
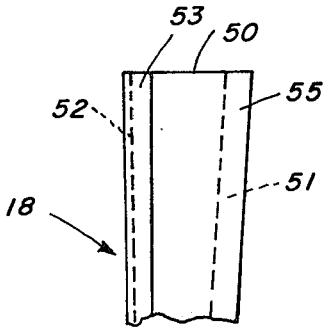
Figure 9:
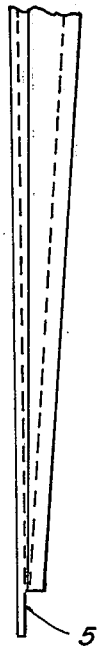

Referring now to FIGS. 9 and 10 there is shown in somewhat greater detail the construction of the arms 18. They comprise a horizontal web or surface 50, and a shorter vertical web or surface 52. The surface 50 has two cuts, a cut 51 on the bottom surface at the free edge, and a cut 53 on the top surface of the edge that carries the vertical surface 52. The purpose of these cuts is to permit the arms 18 to mesh together, to provide overlapping parts 55 into the cut 53, etc. so as to provide a smooth surface, with each of the arms supporting the adjacent one. The portion 57 of the vertical surface 52 is shown in detail in FIG. 3A, and comprises the hook 54.

Figure 7:
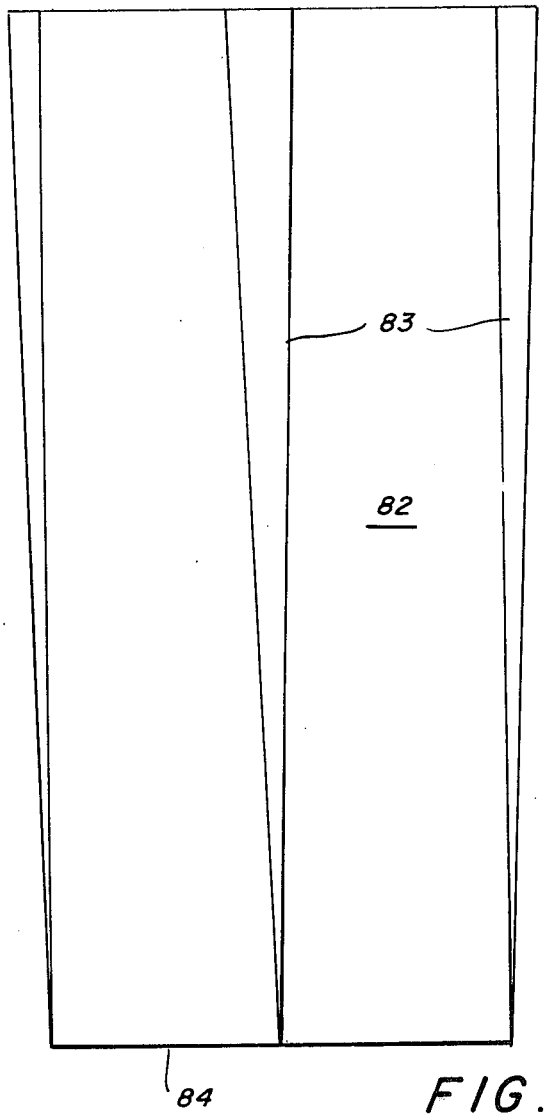
FIGS. 7 and 8 show two views of a thin-walled canister which can be used alternatively to contain the folded table, or to be used as a stool.
Figure 8:
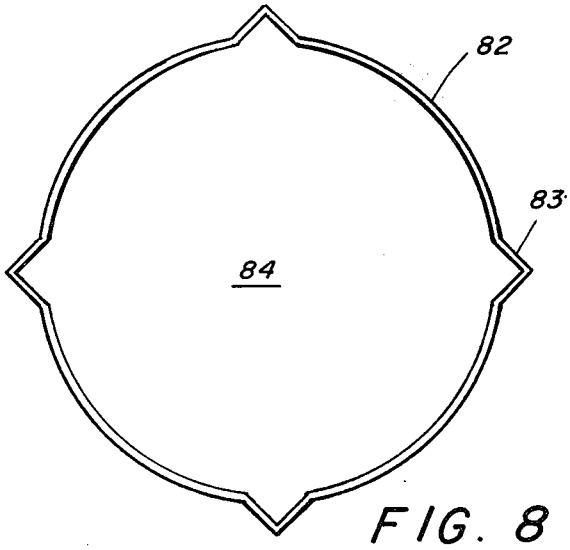

In FIGS. 7 and 8 are shown two views of a canister or thin walled cylindrical container, which is used alternately as a stool, so that a person can sit on the closed surface 84, and also as a container to house the folded table as shown in FIG. 2. The cylindrical surface 82 has a plurality of tapered triangular ridges 83 so as to provide rigidity and strength to the thin walls, as well as providing means for separating the nested canisters so that they can be removed on from the other.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A folding umbrella table, comprising:

a. a central columnar support, comprising:

1. at least a first upper cylindrical tube;
2. at least a second lower cylindrical tube adapted to slide inside of said upper tube, and including latch means to hold said upper and lower tubes in extended position; and
3. a plurality of feet hingedly mounted inside of said lower tube;

b. a circular table top comprising a central plate attached to the top of said upper tube, the peripheral edge of said plate having a plurality of radial slots spaced equally around the circumference;

c. a plurality of radial arms equal in number to said radial slots formed of angle material having a triangular shaped horizontal web, and means for hinging each of said arms by their vertical webs, one in each of said radial slots;

whereby when said arms arms are in a radial position their triangular webs contiguously fit to form the annular outer portion of said table top;

d. a second plurality of radial support arms, forming a selected fraction of said radial arms and having wide vertical webs equally angularly spaced, serving as support arms, and including means including hinged bracket means for supporting said support arms near their outer ends in a horizontal plane;

e. hinged beam means attached as by hinges in the space between each pair of radial support arms near their ends;

f. the remainder of said radial arms having narrow vertical webs, resting on said hinged beam means.

2. The table as in claim 1 in which said means for hinging each of said arms, comprises:

a. a circular groove cut in the top surface of said plate, near the outer edge;

b. a circular wire ring positioned in said groove;

c. the inner end of the vertical webs of each of said N radial arms cut in the form of a hook; whereby said hooks can be inserted into said grooves and hooked over said wire ring; and d. means to lock said ring and said hooks into said grooves.

3. The table as in claim 1 including a first cylindrical canister for enclosing said arms when in a collapsed position.

4. The table as in claim 3 including a plurality of canisters each nesting with each other and said first canister.

5. The table as in claim 1 in which said hinged beam means are attached to said support brackets by double hinge means having hinge axis in both radial and axial directions.

6. The table as in claim 1 and including flexible strap band means to encircle to ends of said arms when said arms are extended horizontally, and including tab means attached separately between said band means and the ends of each of said arm means.

* * * * *